US011517939B1

(12) United States Patent
Knepp

(10) Patent No.: US 11,517,939 B1
(45) Date of Patent: Dec. 6, 2022

(54) WOVEN WIRE SCREENING AND METHODS OF FORMING THE SAME

(71) Applicant: Fenner Inc., Harrisburg, PA (US)

(72) Inventor: Boyd Knepp, Lancaster, PA (US)

(73) Assignee: FENNER INC., Harrisburg, PA (US)

( * ) Notice: Subject to any disclaimer, the term of this patent is extended or adjusted under 35 U.S.C. 154(b) by 0 days.

(21) Appl. No.: 17/698,234

(22) Filed: Mar. 18, 2022

(51) Int. Cl.
*B07B 1/50* (2006.01)
*B07B 1/46* (2006.01)
*D03D 9/00* (2006.01)

(52) U.S. Cl.
CPC ..... *B07B 1/4672* (2013.01); *B07B 1/50* (2013.01); *D03D 9/00* (2013.01)

(58) Field of Classification Search
CPC ..... B07B 1/4672; B07B 1/50; D03D 9/00
See application file for complete search history.

(56) References Cited

U.S. PATENT DOCUMENTS 1,767,814 A * 6/1930 Punshon ..... B07B 1/4672 D25/48.8
2,062,776 A * 12/1936 Berkowitz ..... A45C 1/06 229/92.7
2,604,989 A * 7/1952 Warhol ..... B07B 1/4672 209/401
2,874,730 A * 2/1959 Pomeroy ..... D03D 25/00 245/2
3,716,138 A * 2/1973 Lumsden ..... B07B 1/4672 245/8
7,581,569 B2 * 9/2009 Beck ..... B07B 1/4672 245/8
7,815,053 B2 * 10/2010 Knepp ..... B07B 1/4672 209/400
8,893,894 B2 * 11/2014 Steadman ..... B07B 1/4672 209/403
8,919,568 B2 * 12/2014 Beck ..... B07B 1/4681 209/403
9,486,837 B2 * 11/2016 Wardell ..... B21F 27/02
9,795,993 B2 * 10/2017 Beck ..... B07B 1/4672
10,029,281 B2 * 7/2018 Knepp ..... B21F 27/02
2008/0190822 A1 * 8/2008 Young ..... B07B 1/48 209/401

* cited by examiner

*Primary Examiner* — Patrick H Mackey
(74) *Attorney, Agent, or Firm* — Merek, Blackmon & Voorhees, LLC

(57) ABSTRACT

A self-cleaning woven wire screening or screen for classifying material. The screening includes a plurality interwoven warp and weft wires forming a plurality of openings in a screen section through which materials to be classified can pass through. The weft wires are preferably configured so that the high points or raised knuckles of the weft wires have a larger diameter, cross-sectional height or thickness than previously possible. Preferably, one or more of weft wires have a configuration that prolongs operational life of the screen or screening and obviates the need for protective encasement blocks (e.g., polyurethane encasement blocks) encasing the weft wires.

17 Claims, 4 Drawing Sheets

WOVEN WIRE SCREENING AND METHODS OF FORMING THE SAME

FIELD OF THE INVENTION

The present invention is directed to woven wire screenings or screens and a method of forming the same. More particularly, a preferred embodiment of the present invention is directed to self-cleaning woven wire screenings used in a shaker or vibrating screen apparatus that classifies material flowing through one or more woven wire screenings or screens.

BACKGROUND OF THE INVENTION

Self-cleaning woven and non-woven wire screenings or screens have previously been used in shaker or vibrating screen apparatus to size material passing through the wire screens. Self-cleaning screenings or screens are particularly advantageous as these types of screens are configured so that there is relative movement between adjacent warp wires. The relative movement of adjacent warp wires prevents or reduces the likelihood of particles from becoming lodged in or otherwise clog material classifying openings of the screen. This self-cleaning attribute is important as particles lodged in between adjacent warp wires or otherwise obstructing classifying openings of the screening or screen significantly and adversely impacts the efficiency of the screen or screening.

Known non-woven self-cleaning screens typically use polyurethane blocks as the sole means for binding a plurality of warp wires which are the only wires in the screen.

Known self-cleaning woven wire screens typically consist of a plurality of interwoven weft and warp wires forming a plurality of openings for permitting suitably sized material to pass through the screen. The classifying openings can take different shapes including but not limited to rectangular, triangular or diamond. In woven self-cleaning screens, the warp wires are maintained in spaced parallel relation by weft wires (also known as fill wires or binding wires) arranged in groups at spaced intervals along the length of the warp wires. An example of a self-cleaning woven screen includes alternating straight and horizontally crimped warp wires forming substantially triangular shaped openings between the straight and horizontally crimped warp wires where the warp wires are maintained in spaced parallel relation by weft/fill/binding wires arranged in groups at spaced intervals along the length of the warp wires. Another example of a self-cleaning screen has all warp wires horizontally crimped forming substantially diamond shaped openings between adjacent crimped warp wires where the warp wires are maintained in spaced parallel relation by weft/fill/binding wires arranged in groups at spaced intervals along the length of the warp wires. A further example of a self-cleaning screen has all straight warp wires where the warp wires are maintained in spaced parallel relation by weft/fill/binding wires arranged in groups at spaced intervals along the length of the warp wires.

Prior known manufacturing process and/or woven screen designs of self-cleaning woven screens have significantly limited the size (i.e., diameter, thickness or cross-sectional height) of wire than can be used as weft wires in a woven screen. Typically, weft wires have a diameter significantly less than the warp wires. When the weft wires are sized to be closer to or the same diameter as the warp wires the screen can deformed. This is due to the machines used to form the woven screening or screen. The machines commonly used to form woven wire screens insert the weft/fill/binding wires perpendicular to the longitudinal axis of the warp wires. This insertion process is followed by a lay bar that moves along and parallel to the longitudinal axis of the warp wires to position the weft/fill/binding wires in an operating position. Larger diameter weft/fill/binding wires that would extend the life of the woven screen deform the warp wires during the above manufacturing process so that the woven screen cannot take its desired operational form.

Weft wires in self-cleaning woven wire screens have high points or raised knuckles that are disposed above the uppermost portion of the warp wires and hence prominently exposed to the flow of material directed on the screen or screening for classification. Due to their prominent exposure, these high points or raised knuckles can wear faster than other portions of the screen or screening. This is particularly true where the weft wires have a diameter less than the diameter of the warp wires. Once the high points or raised knuckles are sufficiently worn (e.g., 30% of the high point or raised knuckle are worn away) the weave of the woven screen can lose its lock and can fall apart. Hence, the limited sizing of the weft wires of previously known self-cleaning woven wire screens of screenings can significantly shorten the operational life of the screen or screening.

To counter the wear issue regarding the high points or raised knuckles of weft/fill/binding wires, weft/fill/binding wires have been encased in polyurethane blocks to protect and prevent wear of the high points or raised knuckles of the weft wires. The encasement of the weft/fill/binding wires with polyurethane blocks adds both labor and material costs. Further, the polyurethane blocks can reduce or restrict relative movement of adjacent warp wires. As previously explained, relative movement of warp wires is an extremely important feature as this relative movement allows the screen to be self-cleaning, i.e., the openings between adjacent warp wires will not become blocked, obstructed or clogged with product passing through the woven screen due to the relative movement of adjacent warp wires.

Hence, there is a significant need for a self-cleaning woven screen having larger diameter, greater thickness or greater cross-section height of high points or raised knuckles of weft/fill/binding wires that will not deform the warp wires during the manufacturing process and that will prolong the life of the self-cleaning woven screen without a protective encasement surrounding and encasing the weft wires.

OBJECTS AND SUMMARY OF THE INVENTION

An object of the present invention is to provide a novel and unobvious self-cleaning woven wire screening and a method of forming the same.

Another object of a preferred embodiment of the present invention is to provide a self-cleaning woven wire screening having weft/fill/binding wires that have a longer operational life than has previously been possible to prolong the life of the self-cleaning woven wire screening.

A further object of a preferred embodiment of the present invention is to provide a self-cleaning woven wire screening that obviates the need for polyurethane blocks encasing sets or groups of weft/fill/binding wires.

Yet another object of a preferred embodiment of the present invention is to provide weft wires configured to provide the high points or raised knuckles with a larger diameter, greater thickness or greater cross-sectional height than has been previously possible prolonging operational life and obviating the need for protective encasements surrounding the sets or groups of weft wires.

Yet a further object of a preferred embodiment of the present is to increase the diameter, thickness or cross-sectional height of the high portions or raised knuckles of weft wires beyond that previously possible by flattening portions of the weft wires other than the high portions or raised knuckles of weft wires.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to a woven wire screening for use in classifying material (e.g., a self-cleaning woven wire screen) having a plurality of warp wires extending in a first direction and a plurality of weft wires extending in a second direction. The second direction is substantially perpendicular to the first direction. The plurality of warp wires and the plurality of weft wires form a woven screen section having a plurality of openings through which material to be classified can pass through. The high portions or raised knuckles of one, some or all the weft wires have a larger diameter, greater thickness or greater cross-sectional height than has been previously possible. Other portions of the weft wires (i.e., portions other than the high points or raised knuckles) are formed, altered, shaped or otherwise manipulated in a manner that allows assembly of the screen or screening without deforming the warp wires during the assembly or manufacturing process.

Another preferred embodiment of the present invention is directed to a self-cleaning woven wire screening for use in classifying material having a plurality of warp wires extending in a first direction and a plurality of weft wires extending in a second direction. The second direction is substantially perpendicular to the first direction. The plurality of warp wires and the plurality of weft wires form a woven screen section having a plurality of openings through which material to be classified can pass. The plurality of weft wires includes a first group of weft wires and a second group of weft wires. Each of the first group of weft wires and the second group of weft wires has two or more weft wires. The first group of weft wires are spaced from the second group of weft wires a sufficient distance to allow relative movement between portions of the plurality of warp wires extending between the first group of weft wires and the second group of weft wires to prevent or reduce clogging of the plurality of openings of the woven screen section. The plurality of weft wires includes a first weft wire having a first portion and a second portion. The first portion of the first weft wire has a cross-sectional height less than a cross-sectional height of the second portion.

Another preferred embodiment of the present invention is directed to a self-cleaning woven wire screening for use in classifying material having a plurality of warp wires extending in a first direction and a plurality of weft wires extending in a second direction. The second direction is substantially perpendicular to the first direction. The plurality of warp wires and the plurality of weft wires form a woven screen section having a plurality of openings through which material to be classified can pass through. The plurality of weft wires includes a first group of weft wires and a second group of weft wires. Each of the first group of weft wires and the second group of weft wires have two or more weft wires. The first group of weft wires are spaced from the second group of weft wires a sufficient distance to allow relative movement between portions of the plurality of warp wires extending between the first group of weft wires and the second group of weft wires to prevent or reduce clogging of the plurality of openings of the woven screen section. The plurality of weft wires includes a first weft wire having a first portion and a second portion. The first portion of the first weft wire is a flattened portion, and the second portion of the first weft wire is a non-flattened portion such that the first portion of the first weft wire has a thickness less than a thickness of the second portion of the first weft wire.

A further preferred embodiment of the present invention is directed to a self-cleaning woven wire screening for use in classifying material having a plurality of warp wires extending in a first direction and a plurality of weft wires extending in a second direction. The second direction is substantially perpendicular to the first direction. The plurality of warp wires and the plurality of weft wires form a woven screen section having a plurality of openings through which material to be classified can pass through. The plurality of weft wires includes a first group of weft wires having two or more weft wires. The first group of weft wires is spaced from an adjacent warp wire binding member a sufficient distance to allow relative movement between portions of the plurality of warp wires extending between the first group of weft wires and the adjacent warp wire binding member to prevent or reduce clogging of the plurality of openings of the screen section. The plurality of weft wires includes a first weft wire having a first portion and a second portion. The first portion of the first weft wire has a substantially flat upper surface, and the second portion of the first weft wire has an arcuate upper surface.

The above summary describes preferred forms of the present invention and is not in any way to be construed as limiting the claimed invention to the preferred forms.

DETAILED DESCRIPTION OF THE PREFERRED EMBODIMENTS OF THE INVENTION

Figure 1:
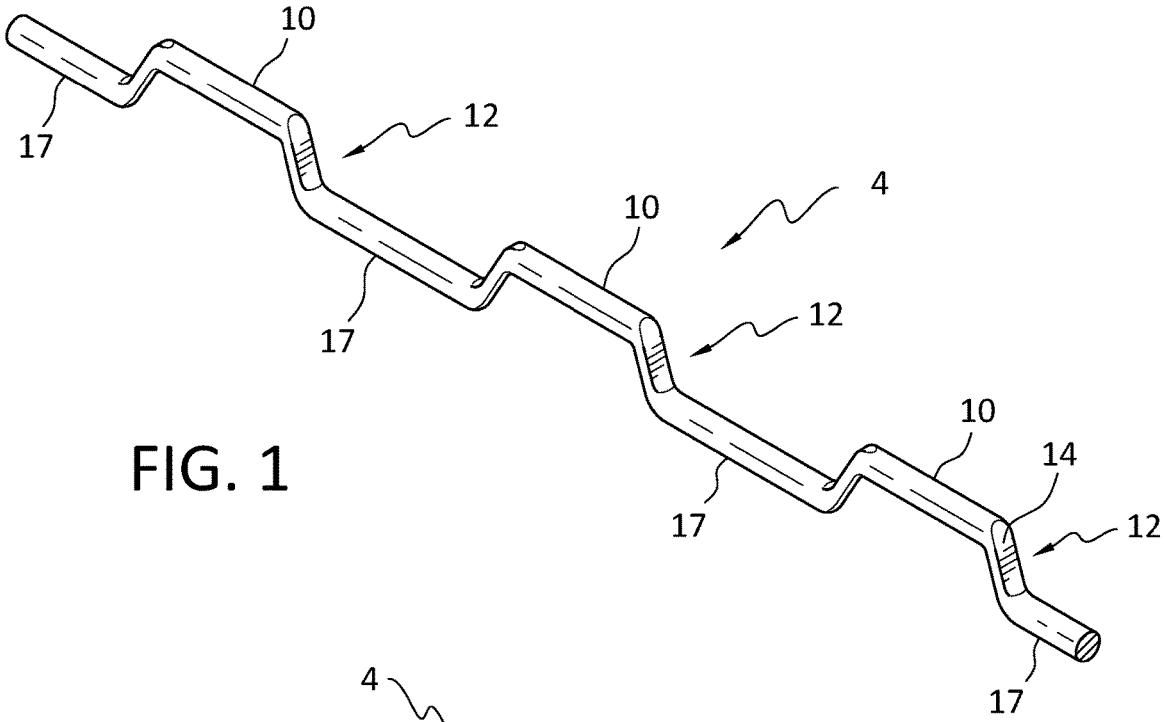
FIG. 1 is a perspective view of a preferred form of a weft wire of a first embodiment.

The preferred forms of the invention are described below with reference to FIGS. 1 through 10. The appended claims are not limited to the preferred forms and no term and/or phrase used herein is to be given a meaning other than its ordinary meaning unless it is expressly stated that the term and/or phrase shall have a special meaning. Cross-sectional height of the section, portion or segment of a weft wire as referred to herein refers to a height of a cross-section taken perpendicular to a direction of extension of the section, portion or segment of the weft wire through which the cross-section is taken.

Preferred embodiments of the present invention are directed to a woven wire screening for use in classifying material (e.g., a self-cleaning woven wire screen) having a plurality of warp wires extending in a first direction and a plurality of weft wires extending in a second direction which is substantially perpendicular to the first direction. The plurality of warp wires and the plurality of weft wires form a woven screen section having a plurality of openings through which material to be classified can pass through. The high portions or raised knuckles of one, some or all the weft wires have a larger diameter, greater thickness or greater cross-sectional height than has been previously possible. Other portions of the weft wires (i.e., portions other than the high points or raised knuckles) are formed, altered, shaped or otherwise manipulated in a manner that allows assembly of the screen or screening without deforming the warp wires during the assembly or manufacturing process.

The preferred forms of the present invention are configured to increase the diameter, thickness or cross-sectional height of the high portions or raised knuckles of weft wires forming a self-cleaning woven wire screen or screening to prolong the life of the screen or screening. Preferably, no protective block surrounding one or more weft wires is used or required. However, the present invention includes and encompasses structures that use a protective block surrounding one or more weft wires to further prolong the operational life of the screen or screening. Each of the warp wires could have the same configuration (e.g., straight or crimped) or differing configurations (e.g., alternating straight warp wires and crimped warp wires). Further, each of the warp wires can be formed from the same size wire or differently sized wires. Moreover, some or all of the warp wires can be shaped wires having, for example, straight sidewalls extending from an uppermost portion of the warp wire to a lowermost portion of the warp wire and/or straight upper and lower surfaces. Alternatively, some of the warp wires can be shaped while other warp wires have a circular or round cross-section. Notably, other configurations are possible, so the claimed invention is not to be limited by any of the preferred embodiments or variations thereof discussed herein. By way of example and without limiting the scope of the present invention, the warp wires can take the form of any of the warp wires disclosed in U.S. Pat. Nos. 7,581,569; 8,919,568; and 9,795,993.

It should be noted that weft wires formed in accordance with the present invention can be used in screens or screening other than self-cleaning woven screens.

Figure 5:
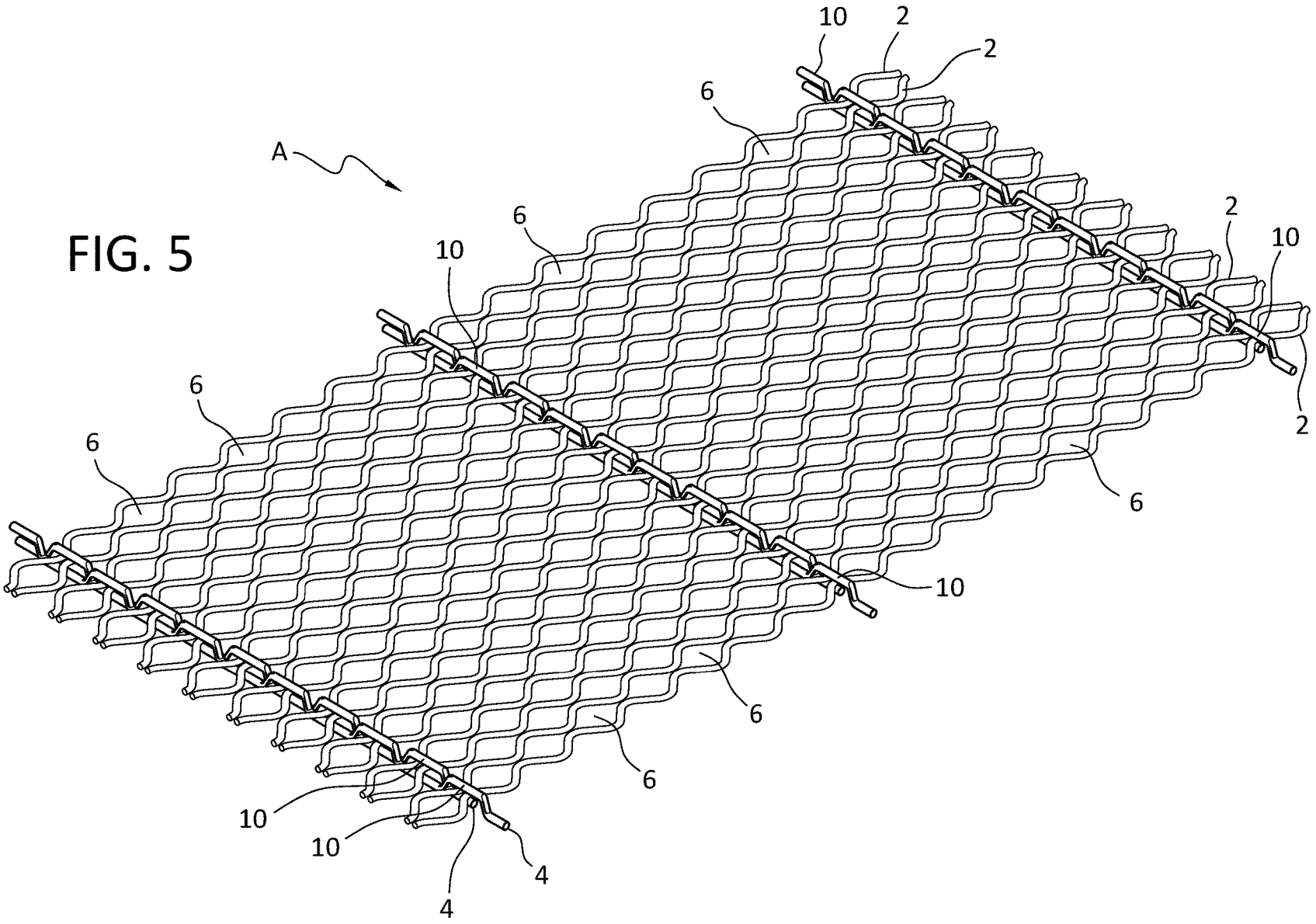
FIG. 5 is a perspective view of one of many different forms of a self-cleaning woven screen or screening that can use weft wires similar to those depicted in FIGS. 1 to 3 having crimped warp wires forming diamond shaped openings.
Figure 6:
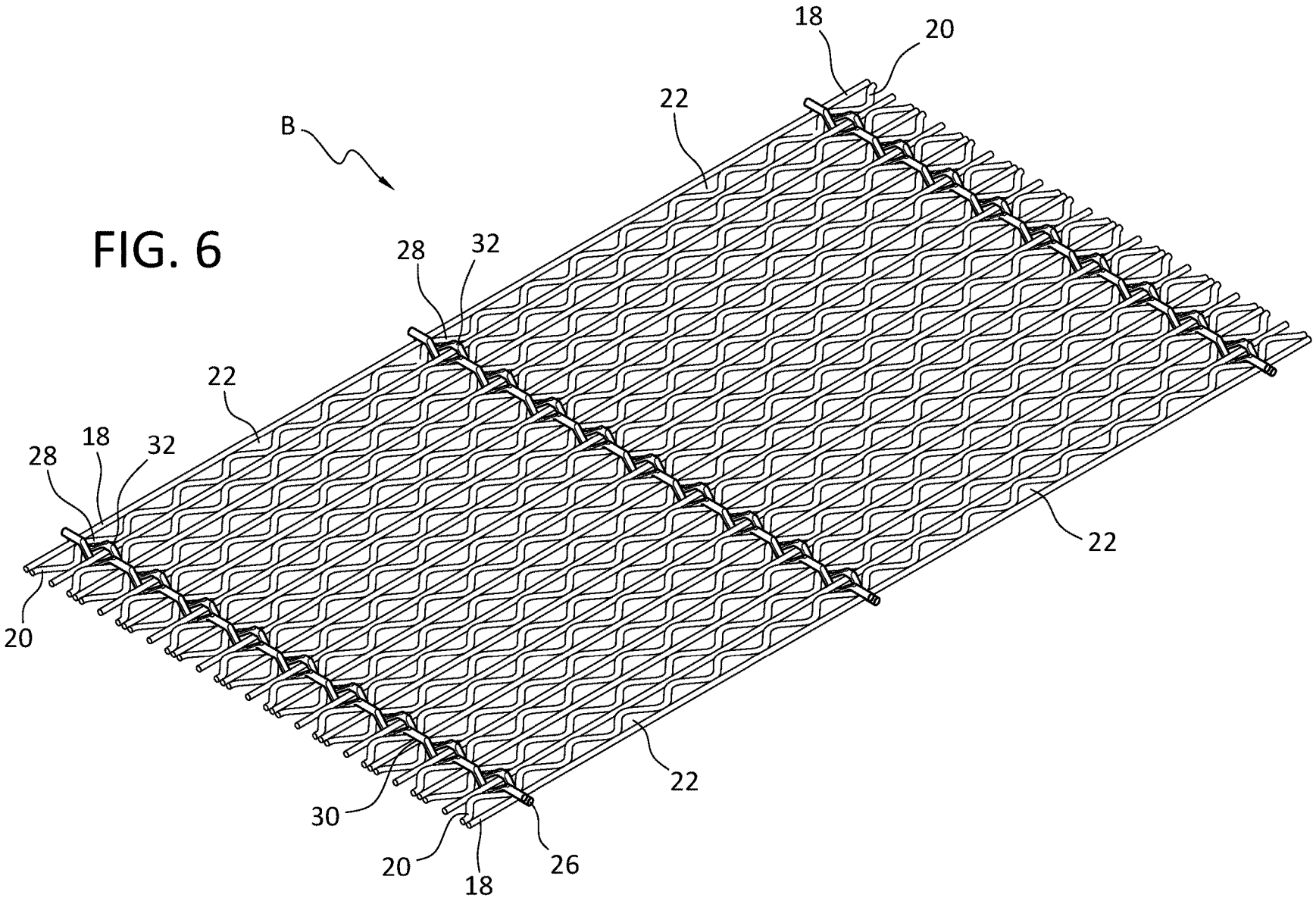
FIG. 6 is a perspective view of another of many different forms of a screen or screening that can use weft wires of the type or similar to the type depicted in FIGS. 7 to 10.
Figure 7:
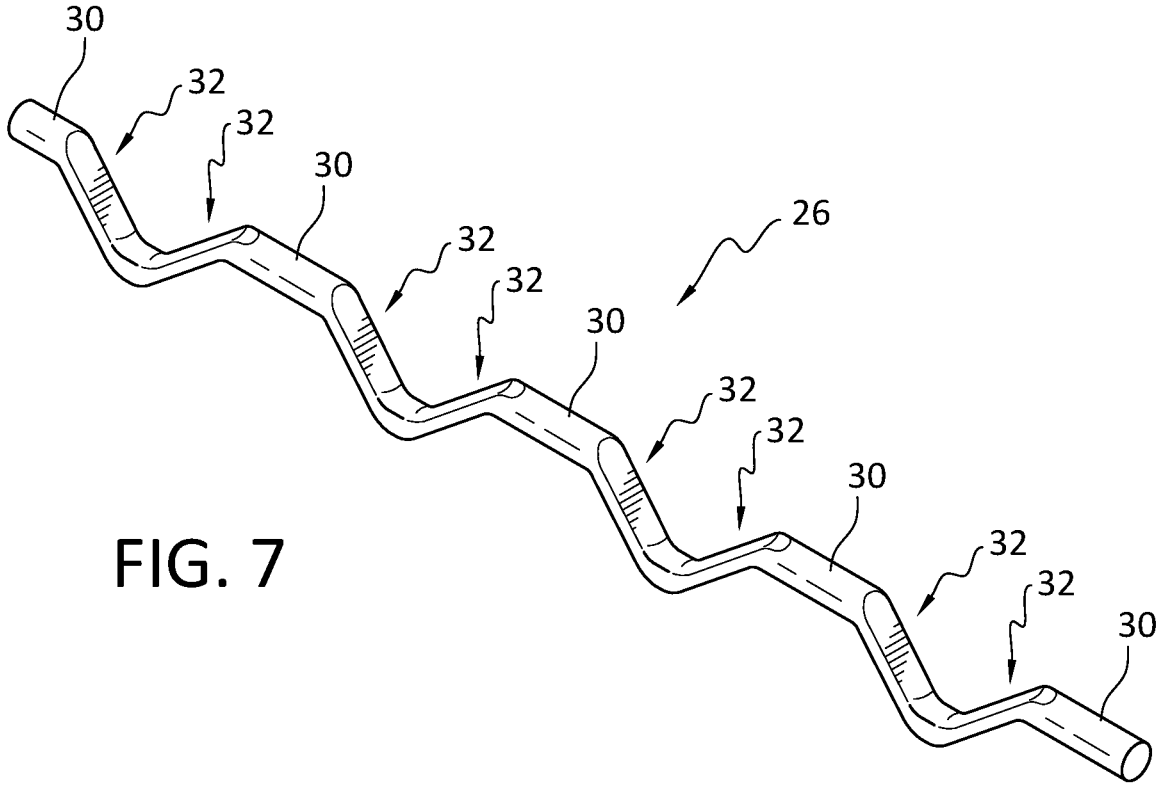
FIG. 7 is a perspective view of a preferred weft wire of the embodiment depicted in FIG. 6.
Figure 8:
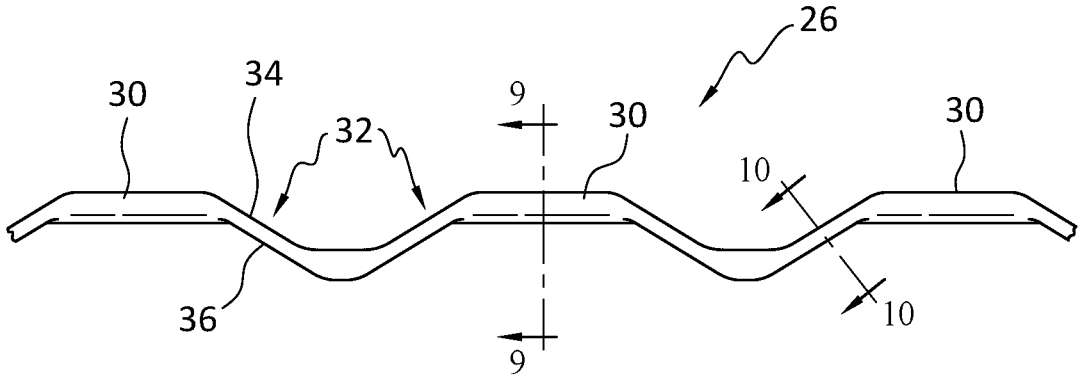
FIG. 8 is a front elevational view of the weft wire depicted in FIG. 7.

Further, while the preferred embodiments depicted in FIGS. 5 and 6 show only weft, fill or binding wires as the members for binding or holding the warp wires together in a desired manner, a combination of weft wires and non-metallic binding members (e.g., polyurethane encasement blocks) can be used wherein the non-metallic binding members do not include any weft, fill or binding wires. For example, one warp wire binding member may include two or more closely spaced weft wire while a directly adjacent warp wire binding member is formed solely from a non-metallic encasement surrounding and encasing portions of the warp wires (e.g., polyurethane blocks).

FIGS. 1 to 5

Referring to FIGS. 1 to 5, a preferred form of self-cleaning woven wire screening or screen A formed in accordance with one preferred embodiment of the present invention is illustrated in one of many possible configurations. Referring to FIG. 5, screen A includes a plurality of warp wires 2 and a plurality of weft/fill/binding wires 4. The weft/fill/binding wires 4 and the warp wires 2 are preferably interwoven to form a plurality of openings 6 in the screen or screening section illustrated in FIG. 5.

Preferably, openings 6 are diamond shaped. However, the shape of the openings can be readily varied as desired. The weft wires 4 and the warp wires 2 can have a circular cross-section. Alternatively, warp wires 2 and/or weft wires 4 can be shaped wires having two substantially flat vertically extending side walls and/or substantially flat upper and lower surfaces. Other wire configurations may be used as desired. Further, while the warp wires 2 depicted in FIG. 5 have the same diameter, the diameter of the warp wires 2 may be varied to increase the tumbling action of materials directed onto the screen.

Preferably, the weft wires 4 are grouped in sets of two or more weft wires. The distance between groups of weft wires is considerably greater than the distance between each weft wire in a grouping of weft wires as seen in FIG. 5 so that the warp wires 2 can move relative to each other to prevent or reduce clogging, blockage or other obstruction of openings 6. In this embodiment, a plurality of openings 6 (e.g., eight openings) are formed by adjacent portions of warp wires 2 extending between two adjacent groups of weft wires 4 (e.g., far right group of weft wires and the middle group of weft wires as seen in FIG. 5).

Preferably, each of the weft wires 4 are configured to maximize the diameter, thickness or cross-sectional height of the high portions or raised knuckles 10 which are prominently exposed to materials impacting the screen or screening while preventing any appreciable deformation of the warp wires when the self-cleaning woven wire screen or screening is formed.

Referring to FIGS. 1 to 5, high portions or raised knuckles 10 have a diameter, thickness or cross-sectional height which is preferably identical to the weft wire prior to alteration, i.e., high portions or raised knuckles 10 are substantially identical or identical to the original form of the wire prior to any alteration of the wire during the manufacturing process. In this preferred embodiment, a round wire has been used for weft wires 4, accordingly, high portions or raised knuckles 10 have a circular or round cross-section that has an identical diameter to the original form of the round wire. Hence, the upper and lower surfaces of high portions or raised knuckles 10 are arcuate.

Figure 2:
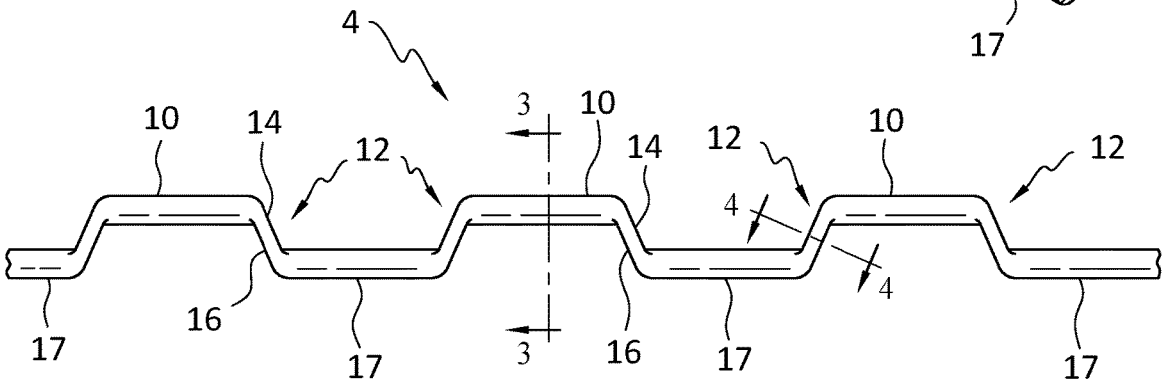
FIG. 2 is a front elevational view of the weft wire depicted in FIG. 1.
Figure 3:
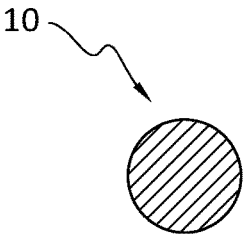
FIG. 3 is a cross-sectional view taken through lines 3-3 in FIG. 2.

Referring to FIGS. 1 and 2, each of the weft wires 4 preferably includes portions 12 extending downwardly from opposing ends of a corresponding high portion or raised knuckle 10. Portions 12 are flattened or otherwise manipulated or formed such that a thickness or cross-sectional height of portions 12 (taken from a cross-section perpendicular to a direction of extension of portions 12) is less than a cross-sectional height or thickness of high portions or raised knuckles 10. This configuration of the weft wires allows for the weft wire to include portions 10 that have a thickness, diameter or cross-sectional height exceeding that of similar portions of conventional screens or screenings.

Portions 12 may have a thickness or cross-sectional height that is 35% to 65% of the thickness or cross-sectional height of wire used to form the weft wires prior to alteration of the original wire. Most preferably, portions 12 may have a thickness that is 40% to 60% of the original thickness or cross-sectional height of portions 10 which has the same thickness or cross-sectional height of the original wire used to form weft wires 4.

Figure 4:
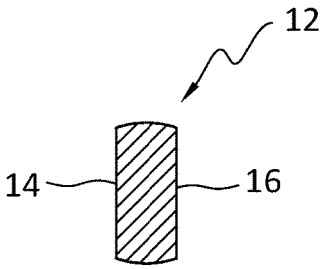
FIG. 4 is a cross-sectional view taken through lines 4-4 in FIG. 2.

Portions 12 preferably have an upper surface 14 and a lower surface 16 which are flat or substantially flat due to a flattening process performed only on portions 12, i.e., high points or raised knuckles 10 are not flattened as such are not subject to a flattening process. The horizontal distance of a line extending perpendicular and between surfaces 14 and 16 is referred to as herein as the thickness or cross-sectional height of portions 12. This horizontal distance is shown in FIG. 4.

Lower portions 17 of weft wires 4 preferably have an identical cross-section as portions 10. However, the configuration of lower portions 17 can be readily varied as desired.

The configuration of weft wires 4 of this embodiment allows the weft wires to be formed from a wire having a diameter greater than, substantially equal to or equal to the diameter of the warp wires. The table below provides examples of possible weft and warp wire sizing for a given screen made possible by the present invention.

| Example number | Warp Wire Size | Weft Wire Size |
|---|---|---|
| Screen #1 | .105 inches | .105 inches |
| Screen #2 | .120 inches | .120 inches |
| Screen #3 | .148 inches | .148 inches |
| Screen #4 | .072 inches | .092 inches |
| Screen #5 | .080 inches | .105 inches |
| Screen #6 | .135 inches | .148 inches |
| Screen #7 | .148 inches | .250 inches |
| Screen #8 | .120 inches | .207 inches |
| Screen #9 | .050 inches | .105 inches |
| Screen #10 | .036 inches | .080 inches |

With larger weft/fill/binding wires, it is believed that the thickness or cross-sectional height of portions 12 should be less than 50% of the thickness or cross-sectional height of the original wire (i.e., the wire prior to any alteration) to achieve optimal results. For example, where the weft/fill/binding wires have a diameter of 0.250 inches and the warp wires have a diameter of 0.148 inches, it is believed that portions 12 optimally should have a cross-sectional height of 40.8% of the thickness or cross-sectional height of the original wire. Where the weft/fill/binding wires have a diameter of 0.207 inches and the warp wires have a diameter of 0.120 inches, it is believed that portions 12 optimally should have a cross-sectional height of 42.1% of the thickness or cross-sectional height of the original wire. However, the percentage of flattening can be varied as desired or needed for a particular screen configuration.

With smaller weft/fill/binding wires, the thickness or cross-sectional height of portions 12 can exceed 50% of the thickness or cross-sectional height of the original wire. Where the weft/fill/binding wires have a diameter of 0.105 inches and the warp wires have a diameter of 0.050 inches, portions 12 can have a cross-sectional height of 52.4% of the thickness or cross-sectional height of the original wire. Where the weft/fill/binding wires have a diameter of 0.080 inches and the warp wires have a diameter of 0.036 inches, portions 12 can have a cross-sectional height of 55% of the thickness or cross-sectional height of the original wire. However, the percentage of flattening can be varied as desired or needed for a particular screen configuration.

As is readily seen from the above discussion, the weft wires 4 can have a diameter that is more than twice the diameter of the warp wires 2.

FIGS. 6 to 10

Referring to FIGS. 6 to 10, a preferred form of self-cleaning woven wire screening or screen B formed in accordance with another preferred embodiment of the present invention is illustrated in one of many possible configurations. Referring to FIG. 6, screen B includes a plurality of a first set of warp wires 18 and a plurality of a second set of warp wires 20. In this preferred embodiment, warp wires 18 are straight wires and warp wires 20 are horizontally crimped. In this preferred embodiment, warp wires 18 and 20 alternate so that a plurality of triangular shaped openings 22 are formed between a straight warp wire 18 and a directly adjacent horizontally crimped warp wire 20. However, the shape of the openings can be readily varied as desired.

By way of example and without limitation, all warp wires could be straight wires forming rectangular shaped openings in the screen section. While all warp wires shown in FIG. 6 have a round or circular cross-section, the straight and/or crimped warp wires could be shaped wires having two substantially flat sidewalls and/or two substantially flat upper and lower surfaces. Further, while all warp wires are shown as being formed from a wire having the same diameter, the diameter sizing of the straight and/or crimped wires may be varied to, for example, increase the tumbling action of the screen or screening.

Referring to FIGS. 6 to 10, the weft wires are formed to increase the wear life of the high point or raised knuckles to significantly prolong the life of the screen or screening. Referring to FIG. 6, weft wires may have different orientations. For example, FIG. 6 depicts two different orientations of weft wires 26 and 28 with weft wire 26 orientated to have a substantially horizontally extending high portion or raised knuckle 30 forming an uppermost portion of the weft wire 26 that receives multiple warp wires (e.g., three warp wires as shown in FIG. 6—two of which are straight warp wires 18 and one of which is a crimped warp wire 20) and weft wire 28 having a high portion or raised knuckle 32 receiving a single warp wire.

Preferably, weft wires 26 and 28 have the same or similar configuration differing only in orientation. Therefore, only the configuration of weft wires 26 will be descried in detail.

Referring to FIGS. 6 to 10, each of the weft wires 26 includes high point or raised knuckles 30 and portions 32 which extend downwardly from opposing ends of a corresponding high portion or raised knuckle 30. Portions 32 are flattened or otherwise manipulated or formed such that a thickness or cross-sectional height of portions 32 (taken from a cross-section perpendicular to a direction of extension of portions 12) is less than a cross-sectional height or thickness of high portions or raised knuckles 30. This configuration of the weft wires allows for the weft wire to include portions 30 that have a thickness, diameter or cross-sectional height exceeding that of similar portions of conventional screens or screenings. Portions 32 may have a thickness or cross-sectional height that is 35% to 65% of the original thickness or cross-sectional height of the weft wires portions 30 have 100% of the original thickness or cross-sectional height of the weft wires. Most preferably, portions 32 may have a thickness that is 40% to 60% of the thickness of portions 30 which have the same thickness as the original wire used to form the weft wires.

Figure 9:
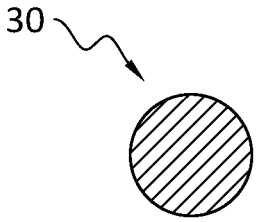
FIG. 9 is a cross-sectional view taken through lines 9-9 in FIG. 8.
Figure 10:
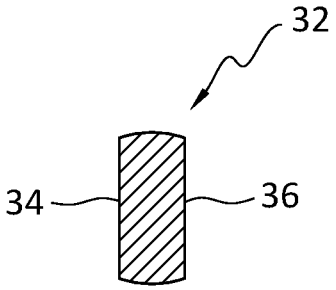
FIG. 10 is a cross-sectional view taken through lines 10-10 in FIG. 8.

Referring to FIGS. 9 and 10, portions 32 preferably have an upper surface 34 and a lower surface 36 which are flat or substantially flat due to a flattening process performed only on portions 30, i.e., high points or raised knuckles 30 are not flattened as such are not subject to a flattening process. The horizontal distance of a line extending perpendicular to and between surfaces 34 and 36 is referred to as herein as the thickness or cross-sectional height of portions 32.

The configuration of weft wires 26 and 28 of this embodiment allow the weft wires to be formed from a wire having a diameter greater than, substantially equal to or equal to the diameter of the warp wires. The table below provides examples of possible weft and warp wire sizing made possible by the present invention.

| Example number | Warp Wire Size | Weft Wire Size |
|---|---|---|
| Screen #1 | .105 inches | .105 inches |
| Screen #2 | .120 inches | .120 inches |
| Screen #3 | .148 inches | .148 inches |
| Screen #4 | .072 inches | .092 inches |
| Screen #5 | .080 inches | .105 inches |
| Screen #6 | .135 inches | .148 inches |
| Screen #7 | .148 inches | .250 inches |
| Screen #8 | .120 inches | .207 inches |
| Screen #9 | .050 inches | .105 inches |
| Screen #10 | .036 inches | .080 inches |

With larger weft/fill/binding wires, it is believed that the thickness or cross-sectional height of portions 32 should be less than 50% of the thickness or cross-sectional height of the original wire to achieve optimal results. For example, where the weft/fill/binding wires have a diameter of 0.250 inches and the warp wires have a diameter of 0.148 inches, it is believed that portions 32 optimally should have a cross-sectional height of 40.8% of the thickness or cross-sectional height of the original wire. Where the weft/fill/binding wires have a diameter of 0.207 inches and the warp wires have a diameter of 0.120 inches, it is believed that portions 32 optimally should have a cross-sectional height of 42.1% of the thickness or cross-sectional height of the original wire. However, the percentage of flattening can be varied as desired or needed for a particular screen configuration.

With smaller weft/fill/binding wires, the thickness or cross-sectional height of portions 32 can exceed 50% of the thickness or cross-sectional height of the original wire. Where the weft/fill/binding wires have a diameter of 0.105 inches and the warp wires have a diameter of 0.050 inches, portions 32 can have a cross-sectional height of 52.4% of the thickness or cross-sectional height of the original wire. Where the weft/fill/binding wires have a diameter of 0.080 inches and the warp wires have a diameter of 0.036 inches, portions 32 can have a cross-sectional height of 55% of the thickness or cross-sectional height of the original wire. However, the percentage of flattening can be varied as desired or needed for a particular screen configuration.

As is readily seen from the above discussion, the weft wires 26 and 28 can have a diameter that is more than twice the diameter of the warp wires 18 and 20.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. A self-cleaning woven wire screening for use in classifying material; comprising:

(a) a plurality of warp wires extending in a first direction;

(b) a plurality of weft wires extending in a second direction, the second direction being substantially perpendicular to the first direction, said plurality of warp wires and said plurality of weft wires forming a woven screen section having a plurality of openings through which material to be classified can pass through;

(c) said plurality of weft wires including a first group of weft wires and a second group of weft wires, each of said first group of weft wires and said second group of weft wires having two or more weft wires, said first group of weft wires being spaced from said second group of weft wires to allow relative movement between portions of said plurality of warp wires extending between said first group of weft wires and said second group of weft wires to prevent or reduce clogging of the plurality of openings of said woven screen section; and, (d) said plurality of weft wires having a first weft wire including a first portion and a second portion, said first portion of said first weft wire has a cross-sectional height less than a cross-sectional height of said second portion of said first weft wire, wherein said second portion of said first weft wire forms an uppermost portion of said first weft wire and said first portion of said first weft wire extends downwardly from said second portion of said first weft wire.

2. The self-cleaning woven wire screening as set forth in claim 1, wherein:

(a) said first weft wire is formed from a wire having a uniform cross-sectional height, said second portion of said first weft wire has a cross-sectional height identical to the uniform cross-sectional height of the wire from which said first weft wire is formed from and said first portion of said weft wire has a cross-sectional height less than the uniform cross-sectional height of the wire from which said first weft wire is formed from.

3. The self-cleaning woven wire screening as set forth in claim 1, wherein:

(a) said plurality of warp wires includes a plurality of straight warp wires.

4. The self-cleaning woven wire screening as set forth in claim 1, wherein:

(a) said plurality of warp wires includes a plurality of horizontally crimped warp wires.

5. The self-cleaning woven wire screening as set forth in claim 1, wherein:

(a) each of said plurality of warp wires has an identical height.

6. A self-cleaning woven wire screening for use in classifying material; comprising:

(a) a plurality of warp wires extending in a first direction;

(b) a plurality of weft wires extending in a second direction, the second direction being substantially perpendicular to the first direction, said plurality of warp wires and said plurality of weft wires forming a woven screen section having a plurality of openings through which material to be classified can pass through;

(c) said plurality of weft wires including a first group of weft wires and a second group of weft wires, each of said first group of weft wires and said second group of weft wires having two or more weft wires, said first group of weft wires being spaced from said second group of weft wires to allow relative movement between portions of said plurality of warp wires extending between said first group of weft wires and said second group of weft wires to prevent or reduce clogging of the plurality of openings of said woven screen section; and, (d) said plurality of weft wires having a first weft wire including a first portion and a second portion, said first portion of said first weft wire has a cross-sectional height less than a cross-sectional height of said second portion of said first weft wire, wherein said first portion of said first weft wire is flattened such that said first portion of said first weft wire has a cross-sectional height 35% to 65% less than a cross-sectional height of said second portion of said first weft wire.

7. A self-cleaning woven wire screening for use in classifying material; comprising:

(a) a plurality of warp wires extending in a first direction;

(b) a plurality of weft wires extending in a second direction, the second direction being substantially perpendicular to the first direction, said plurality of warp wires and said plurality of weft wires forming a woven screen section having a plurality of openings through which material to be classified can pass through;

(c) said plurality of weft wires including a first group of weft wires and a second group of weft wires, each of said first group of weft wires and said second group of weft wires having two or more weft wires, said first group of weft wires being spaced from said second group of weft wires to allow relative movement between portions of the plurality of warp wires extending between said first group of weft wires and said second group of weft wires to prevent or reduce clogging of the plurality of openings of said woven screen section; and, (d) said plurality of weft wires include a first weft wire having a first portion and a second portion, said first portion of said first weft wire is a flattened portion and said second portion of said first weft wire is a non-flattened portion such that said first portion of said first weft wire has a thickness less than a thickness of said second portion of said first weft wire, wherein said second portion of said first weft wire forms an uppermost portion of said first weft wire and said first portion of said first weft wire extends downwardly from said second portion of said first weft wire.

8. The self-cleaning woven wire screening as set forth in claim 7, wherein:

(a) said first weft wire includes a third portion connected to said first portion of said first weft wire, said first portion of said first weft wire and said third portion of said first weft wire form a segment of said first weft wire that receives a portion of one or more of said plurality of warp wires.

9. The self-cleaning woven wire screening as set forth in claim 8, wherein:

(a) said third portion of said first weft wire is flattened to have a thickness less than the thickness of said second portion of said first weft wire.

10. The self-cleaning woven wire screening as set forth in claim 9, wherein:

(a) said first weft wire includes a fourth portion connected to said third portion of said first weft wire, said fourth portion of said first weft wire is horizontally aligned with said second portion of said first weft wire, said fourth portion of said first weft wire has a thickness identical to the thickness of said second portion of said first weft wire.

11. A self-cleaning woven wire screening for use in classifying material; comprising:

(a) a plurality of warp wires extending in a first direction;

(b) a plurality of weft wires extending in a second direction, the second direction being substantially perpendicular to the first direction, said plurality of warp wires and said plurality of weft wires form at least a portion of a woven screen section having a plurality of openings through which material to be classified can pass through;

(c) said plurality of weft wires including a first group of weft wires having two or more weft wires, said first group of weft wires being spaced from an adjacent warp wire binding member to allow relative movement between portions of the plurality of warp wires extending between said first group of weft wires and said adjacent warp wire binding member to prevent or reduce clogging of the plurality of openings of said woven screen section; and, (c) said plurality of weft wires include a first weft wire having a first portion and a second portion, said first portion of said first weft wire having a substantially flat upper surface and said second portion of said first weft wire having an arcuate upper surface, wherein said second portion of said first weft wire forms an uppermost portion of said first weft wire.

12. The self-cleaning woven wire screening as set forth in claim 11, wherein:

(a) said first portion of said first weft wire extends downwardly from said second portion of said first weft wire; and, (b) said adjacent warp wire binding member includes a second group of wefts wires having two or more weft wires.

13. The self-cleaning woven wire screening as set forth in claim 12, wherein:

(a) said first portion of said first weft wire is flattened to have a thickness less than a thickness of said second portion of said first weft wire.

14. The self-cleaning woven wire screening as set forth in claim 13, wherein:

(a) each of said plurality of warp wires have an identical diameter.

15. The self-cleaning woven wire screening as set forth in claim 13, wherein:

(a) said first portion of said first weft wire is flattened such that said first portion of said first weft wire has a thickness 35% to 65% less than the thickness of said second portion of said first weft wire.

16. The self-cleaning woven wire screening as set forth in claim 11, wherein:

(a) every warp wire of the self-cleaning woven wire screen is identical.

17. The self-cleaning woven wire screening as set forth in claim 11, wherein:

(a) every warp wire of the self-cleaning woven wire screen is a horizontally crimped wire.

* * * * *